US005921897A

United States Patent [19]

Stevens

[11] Patent Number: 5,921,897

[45] Date of Patent: Jul. 13, 1999

[54] FOLDABLE WEIGHTLIFTING BENCH

[76] Inventor: Clive Graham Stevens, 372 Hills Borough Rd., Auckland, New Zealand

[21] Appl. No.: 08/885,632

[22] Filed: Jun. 30, 1997

[51] Int. Cl.[6] ..... A63B 21/078

[52] U.S. Cl. ..... 482/104; 482/142

[58] Field of Search ..... 482/104, 130, 482/133, 142; 5/136, 167, 620

[56] References Cited

U.S. PATENT DOCUMENTS

| | | | |
|---|---|---|---|
| 4,369,966 | 1/1983 | Silberman et al. | 482/104 |
| 4,634,127 | 1/1987 | Rockwell | 482/142 |
| 5,551,936 | 9/1996 | Parisi et al. | 482/104 |

*Primary Examiner*—John Mulcahy
*Attorney, Agent, or Firm*—Norman E. Lehrer

[57] ABSTRACT

A foldable weightlifting bench includes two supporting members each have a post and a base member is pivotally connected between the two posts. Each of the posts has a connecting member extending laterally therefrom and the base member has a tube formed to one end thereof so that the tube can be selectably connected between the two connecting members in a first and a second position by extending pins through different holes of the tube and the connecting members. The base member has a stand pivotally connected to the other end thereof so that when the base member is pivoted about the tube to an upright direction, the stand is hung on the second end of the base member by gravity.

4 Claims, 4 Drawing Sheets

FOLDABLE WEIGHTLIFTING BENCH

BACKGROUND OF THE INVENTION

1. Field of the Invention

The present invention relates to a foldable weightlifting bench which can be folded to a compact size for convenient storage.

2. Brief Description of the Prior Art

A conventional weightlifting bench is relatively large and, therefore, occupies a substantial amount of space. If the weight supporting weightlifting bench is used in home, rather than a commercial location such as a health or fitness club, it is desirable to store the weightlifting bench when not in use.

The present invention intends to provide a foldable weightlifting bench wherein the base member thereof can be folded so as to mitigate and/or obviate the above-mentioned problem.

SUMMARY OF THE INVENTION

In accordance with one aspect of the present invention, there is provided a foldable weightlifting bench comprising a pair of supporting members each having a post and a transverse bar perpendicularly connected to a lower end of the post corresponding thereto. Each of the two posts has a connecting member extending laterally therefrom which has at least two first holes and two second holes defined therethrough.

A base member has a first end with a tube transversely connected thereto and a second end with at least one first lug formed laterally thereto. The tube has two third holes defined through each one of two ends thereof and is connected between the two connecting members by extending two first pins through the third holes and the first holes when in a first position, and each pair of third holes and the second holes when in a second position in which the base member is rotated about the tube to an upright direction.

A stand has at least one second lug formed laterally thereto so as to pivotally connect to the first lug by a bolt. The stand has two fourth holes defined diametrically opposite therethrough and the second end of the base member has a tongue extending laterally therefrom which has a fifth hole defined therethrough so that the stand is connected to the second end of the base member by extending a second pin through the fourth holes and the fifth hole.

It is an object of the present invention to provide a foldable weightlifting bench which can be folded by pivoting the base member to an upright direction.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
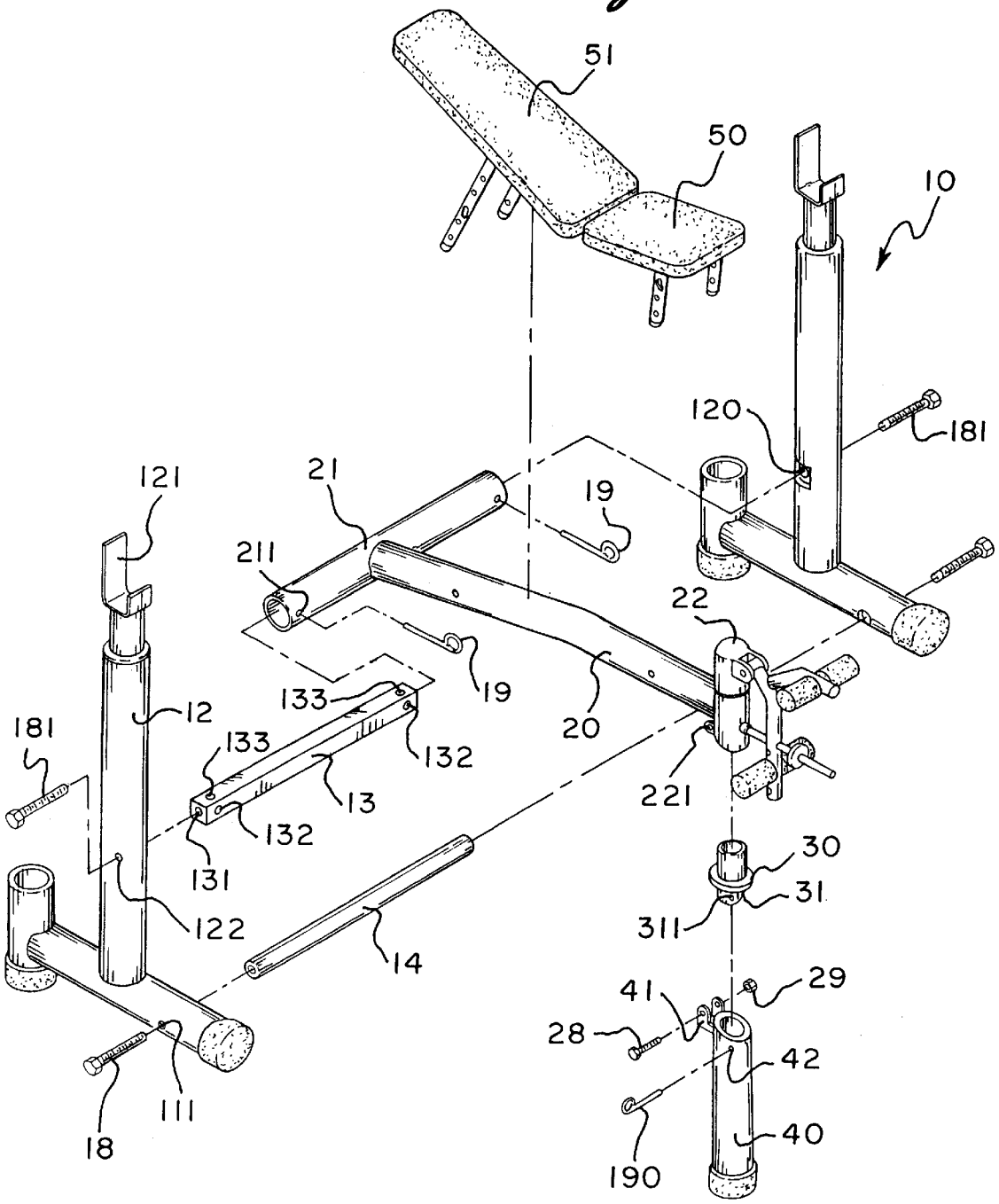
FIG. 1 is an exploded view of a foldable weightlifting bench in accordance with the present invention.
Figure 2:
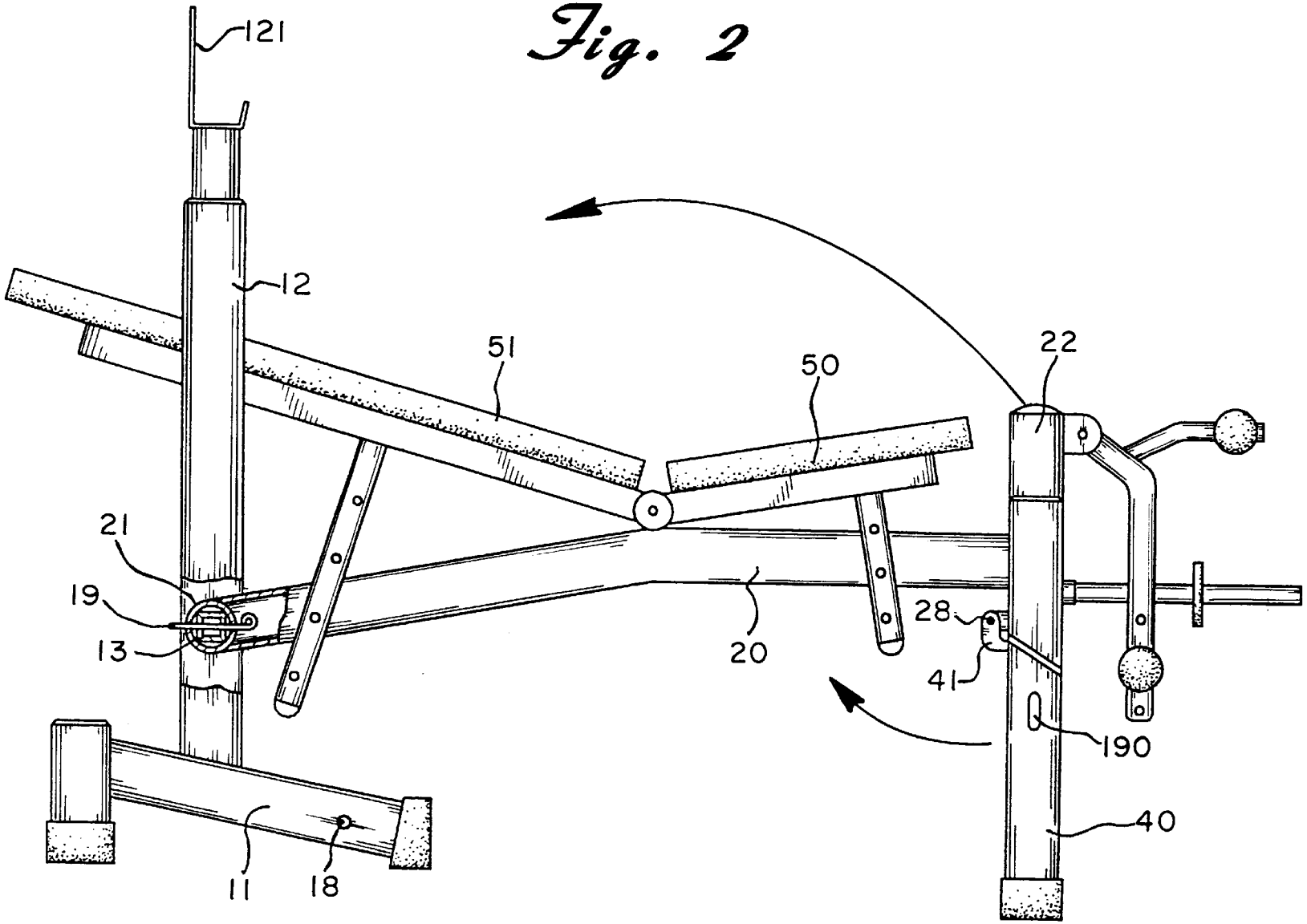
FIG. 2 is a side elevational view showing the pivotal direction to which a base member and a stand of the foldable weightlifting bench are respectively pivoted.
Figure 3:
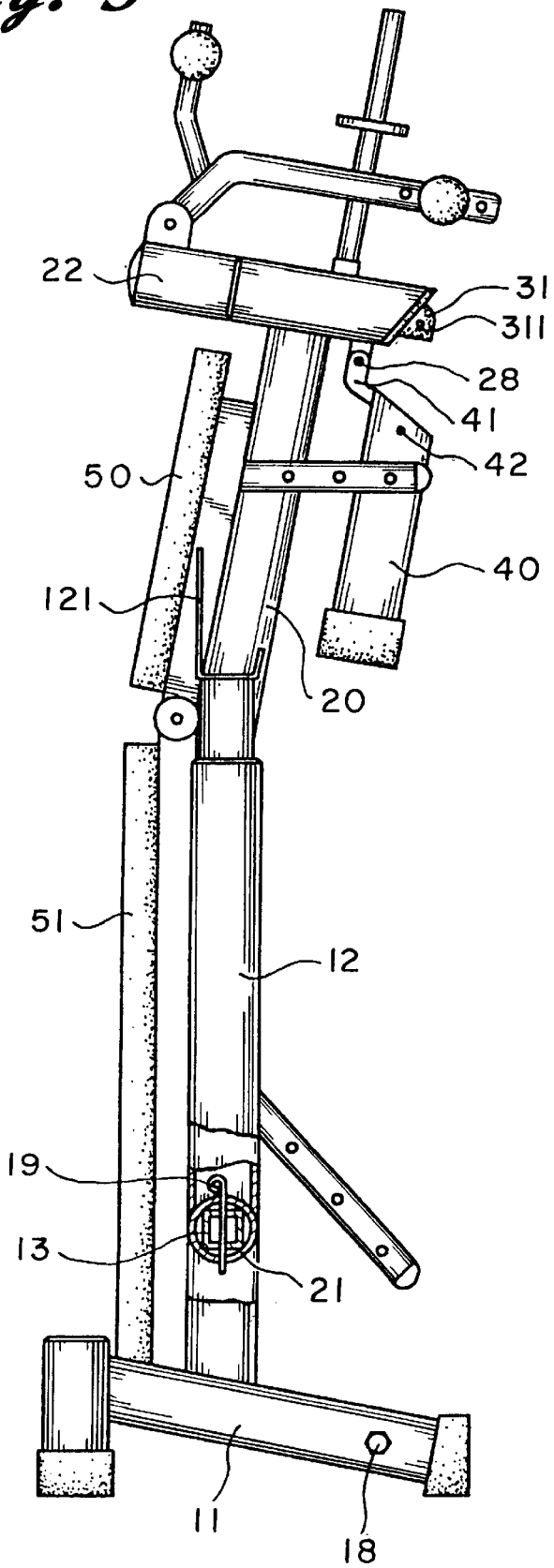
FIG. 3 is a side elevational view showing the weightlifting bench being folded to a compact size.

Referring to the drawings and initially to FIGS. 1 through 3, a foldably weightlifting bench in accordance with the present invention generally includes a pair of supporting members 10 each having a post 12 and a transverse bar 11 perpendicularly connected to a lower end of the post 12 so that the supporting members 10 can be put on the ground. Each of the posts 12 has a U-shaped bracket 121 formed on an upper end thereof so as to let a weight (not shown) be supported on the two brackets 121. A rod 14 is fixedly connected between the two transverse bars 11 by extending bolts 18 through holes 111 defined in the transverse bars 11 and engaged with the rod 14.

Each of the two posts 12 has a transverse hole 122 defined therethrough and a recess 120 defined in an outer periphery thereof wherein the recess 120 communicates with the corresponding transverse hole 121. A connecting rod 13 has its two ends respectively received in the two recesses 120 and is fixedly positioned by extending bolts 181 through the transverse holes 122 and the recesses 120 and engaged with threaded holes 131 respectively defined in the two ends of the connecting rod 13 which has at least two first holes 132 and two second holes 133 defined through a periphery near each one of two ends thereof. Each pair of the first holes 132 and the second holes 133 are located diametrically opposite with each other.

A base 20 has a first end with a tube 21 transversely connected thereto and a second end with an end tube 22 and a stand 40 which is pivotally connected to the end tube 22. The tube 21 has two third holes 211 defined through a periphery thereof near each one of two ends thereof. The tube 21 is rotatably mounted to the connecting rod 13 and is positioned corresponding to the connecting rod 13 by extending two first pins 19 through each pair of the third holes 211 and the first holes 132 when in a first position, and each pair of the third holes 211 and the second holes 133 when in a second position in which the base member 20 is rotated about the connecting rod 13 to an upright direction.

Two first lugs 221 are formed laterally on the end tube 22 and a middle member 30 is inserted into the end tube 22 wherein the middle member 30 has a tongue 31 extending longitudinally from a distal end thereof which has a fifth hole 311 defined therethrough.

The stand 40 has two second lugs 41 formed laterally thereto so as to pivotally connect to the first lugs 221 by extending a bolt 28 through the first and the second lugs 221, 41 and engaging a nut 29. The stand 40 has two fourth holes 42 defined diametrically opposite therethrough so that the stand 40 is connected to the tongue 31 by extending a second pin 190 through the fourth holes 42 and the fifth hole 311. Therefore, the base member 20 is disposed horizontally when in the first position. A seat 50 and a back support 51 are respectively fixedly connected to the base member 20 so that a weightlifter (not shown) may lie on the seat 50 and the back support 51 to lift the weight.

Accordingly, when using the weightlifting bench, the base member 20 is positioned in the first position as shown in FIG. 2 and when folding the weightlifting bench, the base member 20 is pivoted to the second position as shown in FIG. 3 by changing the first pins 19 from the first holes 132 to the second holes 133. When in the second position, the second pin 190 is withdrawn from the stand 40 so that the stand 40 is hung in parallel with the two posts 12 by gravity as shown in FIG. 3.

Figure 4:
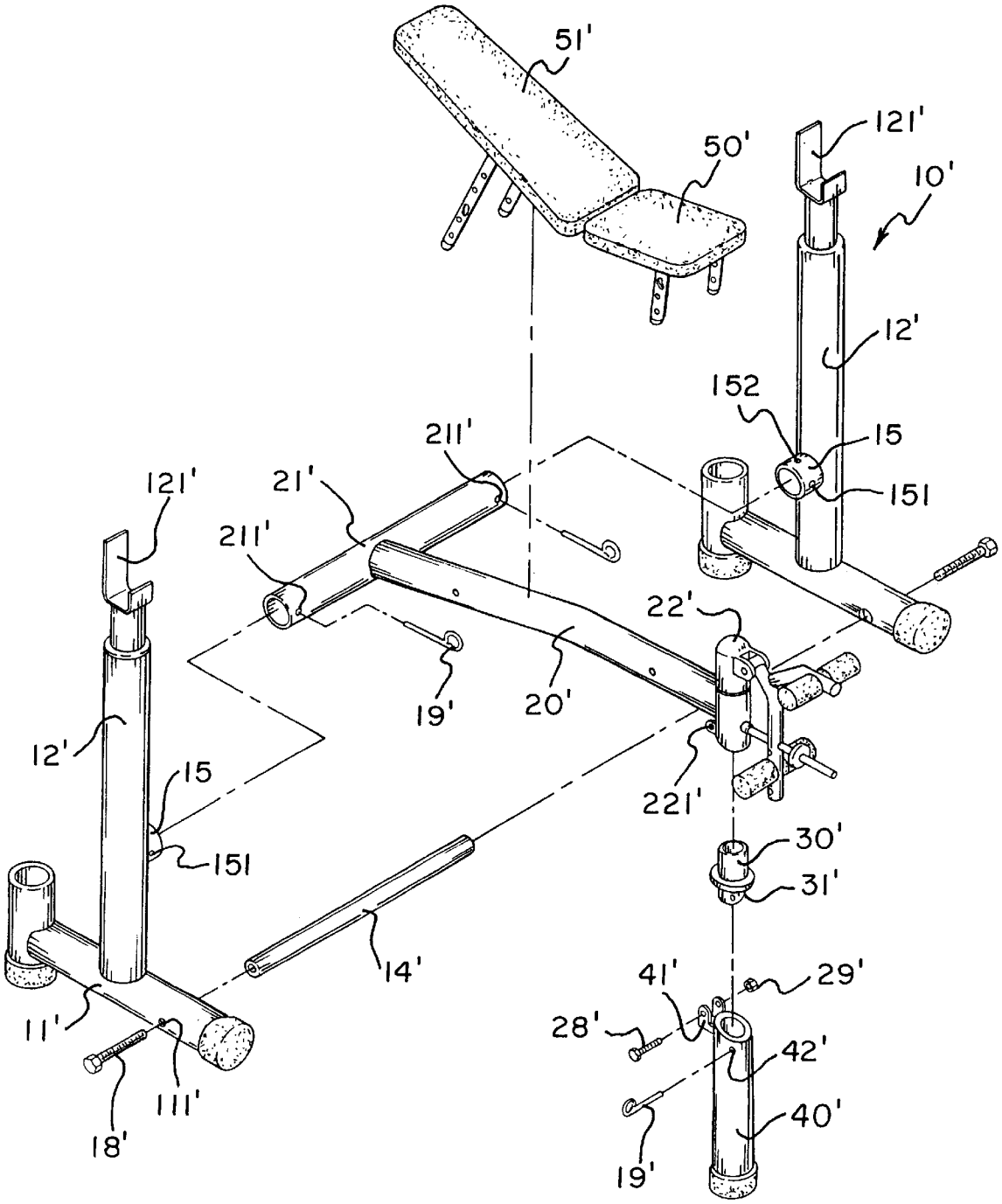
FIG. 4 is an exploded view of another embodiment of the foldable weightlifting bench in accordance with the present invention.

FIG. 4 shows another embodiment of the weightlifting bench wherein the pair of supporting members 10' each have a post 12' and a transverse bar 11' perpendicularly connected to a lower end of the post 12' corresponding thereto so that the supporting members 10' can be put on the ground. Each of the posts 12' has a U-shaped bracket 121' formed on an upper end thereof so as to let a weight (not shown) be supported on the two brackets 121'. A rod 14' is fixedly connected between the two transverse bars 11' by extending bolts 18' through holes 111' defined in the transverse bars 11' and engaged with the rod 14'. A connecting member 15 extends laterally from each one of the two posts 12' and has at least two first holes 151 and two second holes 152 defined through a periphery thereof, each pair of the first holes 151 and the second holes 152 being located diametrically-opposite with each other.

The base member 20' has the same structure as that shown in FIGS. 1–3, that is, the base 20' has a tube 21' formed on a first end thereof and an end tube 22' formed on a second end thereof. The tube 21' has third holes 211' defined through a periphery thereof near each one of two ends thereof and is connected between the two connecting members 15' by extending two first pins 19' through each pair of the third holes 211' and the first holes 151 when in a first position the same as that shown in FIG. 2, and each pair of third holes 211' and the second holes 152 when in a second position as that shown in FIG. 3 in which the base member 20' is rotated about the tube 21' to an upright direction.

Two first lugs 221' are formed laterally on the end tube 22' and a middle member 30' is inserted into the end tube 22' wherein the middle member 30' has a tongue 31' extending longitudinally from a distal end thereof which has a fifth hole 311' defined therethrough.

A stand 40' has two second lugs 41' formed laterally thereto so as to pivotally connect to the first lugs 221' by extending a bolt 28' through the first and the second lugs 221', 41' and engaging a nut 29'. The stand 40' has two fourth holes 42' defined diametrically opposite therethrough so that the stand 40' is connected to the tongue 31' by extending a second pin 190' through the fourth holes 42' and the fifth hole 311'. Therefore, the base member 20' is disposed horizontally when in the first position. A seat 50' and a back support 51' are respectively fixedly connected to the base member 20' so that a weightlifter (not shown) may lie on the seat 50' and the back support 51' to lift the weight.

Although the invention has been explained in relation to its preferred embodiment, it is to be understood that many other possible modifications and variations can be made without departing from the spirit and scope of the invention as hereinafter claimed.

What is claimed is:

1. A foldable weightlifting bench comprising:

a pair of supporting members each having a post and a transverse bar perpendicularly connected to a lower end of said post corresponding thereto, each of said two posts having a connecting member extending laterally therefrom and said connecting members each having at least two first holes and two second holes defined through a periphery thereof, each pair of said first holes and said second holes being located diametrically opposite with each other;

a base member having a first end with a tube transversely connected thereto and a second end with at least one first lug formed laterally thereto, said tube having two third holes defined through a periphery thereof near each one of two ends thereof and connected between said two connecting members by extending two first pins through said third holes and said first holes when in a first position, and said third holes and second holes when in a second position in which said base member is rotated about said tube to an upright direction;

a seat and back support fixedly connected to said base member;

a stand having at least one second lug formed laterally thereto and pivotally connected to said first lug by a bolt, said stand having two fourth holes opposite each other therethrough and said second end of said base member having a tongue extending laterally therefrom which has a fifth hole defined therethrough so that said stand is connected to said second end of said base member by extending a second pin through said fourth holes and said fifth hole.

2. The foldable weightlifting bench as claimed in claim 1 wherein each of said posts has a U-shaped bracket formed on an upper end thereof.

3. The foldable weightlifting bench as claimed in claim 1 wherein said two transverse bars have a rod connected therebetween.

4. A foldable weightlifting bench comprising:

a pair of supporting members each having a post and a transverse bar perpendicularly connected to a lower end of said post corresponding thereto, said two posts having a connecting rod connected therebetween which has at least two first holes and two second holes defined through a periphery thereof near each one of two ends thereof, each pair of said first holes and second holes being located diametrically opposite with each other;

a base member having a first end with a tube transversely connected thereto and a second end with at least one first lug formed laterally thereto, said tube having two third holes defined through a periphery thereof near each one of two ends thereof and said connecting rod received in said tube by extending two first pins through said third holes and said first holes when in a first position, and said third holes and said second holes when in a second position in which said base member is rotated about said connecting rod to an upright direction;

a seat and back support fixedly connected to said base member; and a stand having at least one second lug formed laterally thereto and pivotally connected to the first lug by a bolt, said stand having two fourth holes opposite each other therethrough and said second end of said base member having a tongue extending laterally therefrom which has a fifth hole defined therethrough so that said stand is connected to said second end of said base member by extending a second pin through said fourth holes and said fifth hole.

* * * * *